US005787987A

United States Patent [19]

Forsyth et al.

[11] Patent Number: 5,787,987

[45] Date of Patent: Aug. 4, 1998

[54] LATERAL SEAL AND CONTROL SYSTEM

[75] Inventors: David George Forsyth, Bucksburn; Robert Chapman Ross, Newmachar, both of Scotland; Paul George Lurie, East Horsley, England

[73] Assignee: Baker Hughes Incorporated, Houston, Tex.

[21] Appl. No.: 707,395

[22] Filed: Sep. 4, 1996

Related U.S. Application Data

[60] Provisional application No. 60/003,340 Sep. 6, 1995.

[51] Int. Cl.[6] ..... F21B 7/04; F21B 29/06; F21B 43/14

[52] U.S. Cl. ..... 166/313; 166/50; 166/117.6; 166/382; 175/61

[58] Field of Search ..... 166/50, 117.6, 166/313, 382; 175/61, 79, 80, 81, 82

[56] References Cited

U.S. PATENT DOCUMENTS

| | | | |
|---|---|---|---|
| 2,397,070 | 3/1946 | Zublin | 166/50 |
| 3,842,912 | 10/1974 | Lindsey, Jr. | 166/313 X |
| 5,388,648 | 2/1995 | Jordan, Jr. | 166/50 X |
| 5,477,925 | 12/1995 | Trahan et al. | 166/382 |
| 5,564,503 | 10/1996 | Longbottom et al. | 166/313 |

FOREIGN PATENT DOCUMENTS

| | | |
|---|---|---|
| 2 282 835 | 4/1995 | United Kingdom . |
| 2 295 840 | 6/1996 | United Kingdom . |

*Primary Examiner*—George A. Suchfield

*Attorney, Agent, or Firm*—Fishman, Dionne, Cantor & Colburn

[57] ABSTRACT

A downhole multilateral completion tool is disclosed which includes a premachined window joint and a production tube adapted to be moved downhole through the window joint and kicked off into the pre-drilled lateral. A flange and seal form a part of the uphole end of the production tube and provide a 3500 psi seal after the production tube is placed in the lateral. The invention, moreover, includes an energizing sleeve which biases the flange into a sealed position and a packer which by pulling the production tube, enhances the seal of the flange.

30 Claims, 7 Drawing Sheets

LATERAL SEAL AND CONTROL SYSTEM

CROSS REFERENCE TO RELATED APPLICATIONS

This application claims the benefit of U.S. Provisional application Ser. No. 60/003,340, filed Sep. 6, 1995.

BACKGROUND OF THE INVENTION

This invention relates generally to the completion of wellbores. More particularly, this invention relates to new and improved methods and devices for completion of a branch wellbore extending laterally from a primary well which may be vertical, substantially vertical, inclined or even horizontal. This invention finds particular utility in the completion of multilateral wells, that is, downhole well environments where a plurality of discrete, spaced lateral wells extend from a common vertical wellbore.

Horizontal well drilling and production have been increasingly important to the oil industry in recent years. While horizontal wells have been known for many years, only relatively recently have such wells been determined to be a cost effective alternative (or at least companion) to conventional vertical well drilling. Although drilling a horizontal well costs substantially more than its vertical counterpart, a horizontal well frequently improves production by a factor of five, ten, or even twenty in naturally fractured reservoirs. Generally, projected productivity from a horizontal well must triple that of a vertical hole for horizontal drilling to be economical. This increased production minimizes the number of platforms, cutting investment and operational costs. Horizontal drilling makes reservoirs in urban areas, permafrost zones and deep offshore waters more accessible. Other applications for horizontal wells include periphery wells, thin reservoirs that would require too many vertical wells, and reservoirs with coning problems in which a horizontal well could be optimally distanced from the fluid contact.

Some horizontal wells contain additional wells extending laterally from the primary vertical wells. These additional lateral wells are sometimes referred to as drain holes and vertical wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of horizontal wells, horizontal well completion, and particularly multilateral well completion have posed important concerns and have provided (and continue to provide) a host of difficult problems to overcome. Lateral completion, particularly at the juncture between the vertical and lateral wellbore is extremely important in order to avoid collapse of the well in unconsolidated or weakly consolidated formations. Thus, open hole completions are limited to competent rock formations; and even then open hole completion is inadequate since there is no control or ability to re-access (or re-enter the lateral) or to isolate production zones within the well. Coupled with this need to complete lateral wells is the growing desire to maintain the size of the wellbore in the lateral well as close as possible to the size of the primary vertical wellbore for ease of drilling and completion.

Conventionally, horizontal wells have been completed using either slotted liner completion, external casing packers (ECP's) or cementing techniques. The primary purpose of inserting a slotted liner in a horizontal well is to guard against hole collapse. Additionally, a liner provides a convenient path to insert various tools such as coiled tubing in a horizontal well. Three types of liners have been used namely (1) perforated liners, where holes are drilled in the liner, (2) slotted liners, where slots of various width and depth are milled along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a horizontal well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long horizontal well bore into several small sections. This method provides limited zone isolation, which can be used for stimulation or production control along the well length. However, ECP's are also associated with certain drawbacks and deficiencies. For example, normal horizontal wells are not truly horizontal over their entire length, rather they have many bends and curves. In a hole with several bends it may be difficult to insert a liner with several external casing packers.

Finally, it is possible to cement and perforate medium and long radius wells are shown, for example, in U.S. Pat. No. 4,436,165.

While sealing the juncture between a vertical and lateral well is of importance in both horizontal and multilateral wells, re-entry and zone isolation is of particular importance and pose particularly difficult problems in multilateral well completions. Reentering lateral wells is necessary to perform completion work, additional drilling and/or remedial and stimulation work. Isolating a lateral well from other lateral branches is necessary to prevent migration of fluids and to comply with completion practices and regulations regarding the separate production of different production zones. Zonal isolation may also be needed if the borehole drifts in and out of the target reservoir because of insufficient geological knowledge or poor directional control; and because of pressure differentials in vertically displaced strata as will be discussed below.

When horizontal boreholes are drilled in naturally fractured reservoirs, zonal isolation is seen as desirable. Initial pressure in naturally fractured formations may vary from one fracture to the next, as may the hydrocarbon gravity and likelihood of coning. Allowing them to produce together permits crossflow between fractures and a single fracture with early water breakthrough jeopardizes the entire well's production.

As mentioned above, initially horizontal wells were completed with uncemented slotted liners unless the formation was strong enough for an open hole completion. Both methods make it difficult to determine producing zones and, if problems develop, practically impossible to selectively treat the right zone. Today, zone isolation is achieved using either external casing packers on slotted or perforated liners or by conventional cementing and perforating.

The problem of lateral wellbore (and particularly multilateral wellbore) completion has been recognized for many years as reflected in the patent literature. For example, U.S.

Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple horizontal wells. U.S. Pat. No. 5,318,122, which is assigned to the assignee hereof and incorporated herein by reference, discloses deformable devices that selectively seal the juncture between the vertical and lateral wells using an inflatable mold which utilizes a hardenable liquid to form a seal, expandable memory metal devices or other devices for plastically deforming a sealing material. U.S. Pat. Nos. 4,396,075; 4,415,205; 4,444,276 and 4,573,541 all relate generally to methods and devices for multilateral completion using a template or tube guide head. Other patents and patent applications of general interest in the field of horizontal well completion include U.S. Pat. Nos. 2,452,920, 4,402,551, 5,289,876, 5,301,760, 5,337,808, Australian patent application 40168/93, U.S. application Ser. No. 08/306,497 filed Sep. 15, 1994, now U.S. Pat. No. 5,526,880, which is assigned to the assignee hereof and incorporated herein by reference, and U.S. Ser. No. 08/188,998 filed Jan. 26, 1994, now U.S. Pat. No. 5,474,131, which is also commonly assigned and incorporated herein by reference.

Notwithstanding the above-described attempts at obtaining cost effective and workable lateral well completions, there continues to be a need for new and improved methods and devices for providing such completions, particularly sealing between the juncture of vertical and lateral wells, the ability to re-enter lateral wells (particularly in multilateral systems) and achieving zone isolation between respective lateral wells in a multilateral well system.

SUMMARY OF THE INVENTION

The above-discussed and other drawbacks and deficiencies of the prior art are overcome or alleviated by the lateral seal and control system of the invention.

The invention is most broadly related to sealing the junction between a primary and a lateral borehole where a flange is provided on a lateral tubular member having an angle which closely mimics the angle of the whipstock used to deflect the original drill string that created the lateral.

Important to borehole operation is that the lateral be properly sealed above and below the joint (by, for example, packers) and that the joint itself be tightly sealed. In order to achieve the desire end, the invention provides a properly oriented production pipe with a flange and a flange seal and most preferably a pre-machined window joint. The flange and seal are of a larger dimension than that of the window against which they will seal. The pipe is kicked into the lateral and penetrates the lateral until the flange seals in the window to seal the joint (under pressure from above or tensile stress from below or both). The kicker can be mechanical, hydraulic or electrical and is positioned at the downhole end of the production pipe. The window may be in a pre-machined pipe (which would carry the production pipe) or the window may be the casing of the lateral where that casing intersects the casing of the primary. The flange, which generally comprises a substantially rigid support and an elastomeric or other suitable sealing component is affixed to the uphole end of the production pipe. With increasing pressure applied to the mating surfaces the seal is better. The pressure may be applied in a number of ways including pressure from other components within the window joint or down hole tensile stress from below in the form of a pulling mechanism. The device also could employ both mechanisms to provide redundancy of the seal. The latter is more fully expressed in connection with the detailed description of the preferred embodiments. The arrangement seals the joint itself. The invention then provides annular seals both above the joint and below the joint which fill the annulus created around the string. Packers may be employed for this function, with particular types being chosen for particular effects. It will be understood, however, that other seals are also applicable providing they are effective in preventing the leakage of fluid. Leakage of such fluid which may occur at the joint between primary and lateral is undesirable due to the potential for contamination of the target fluid. The invention provides a structure which can be employed as a unit in one trip or as separate parts in a series of trips if desired.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
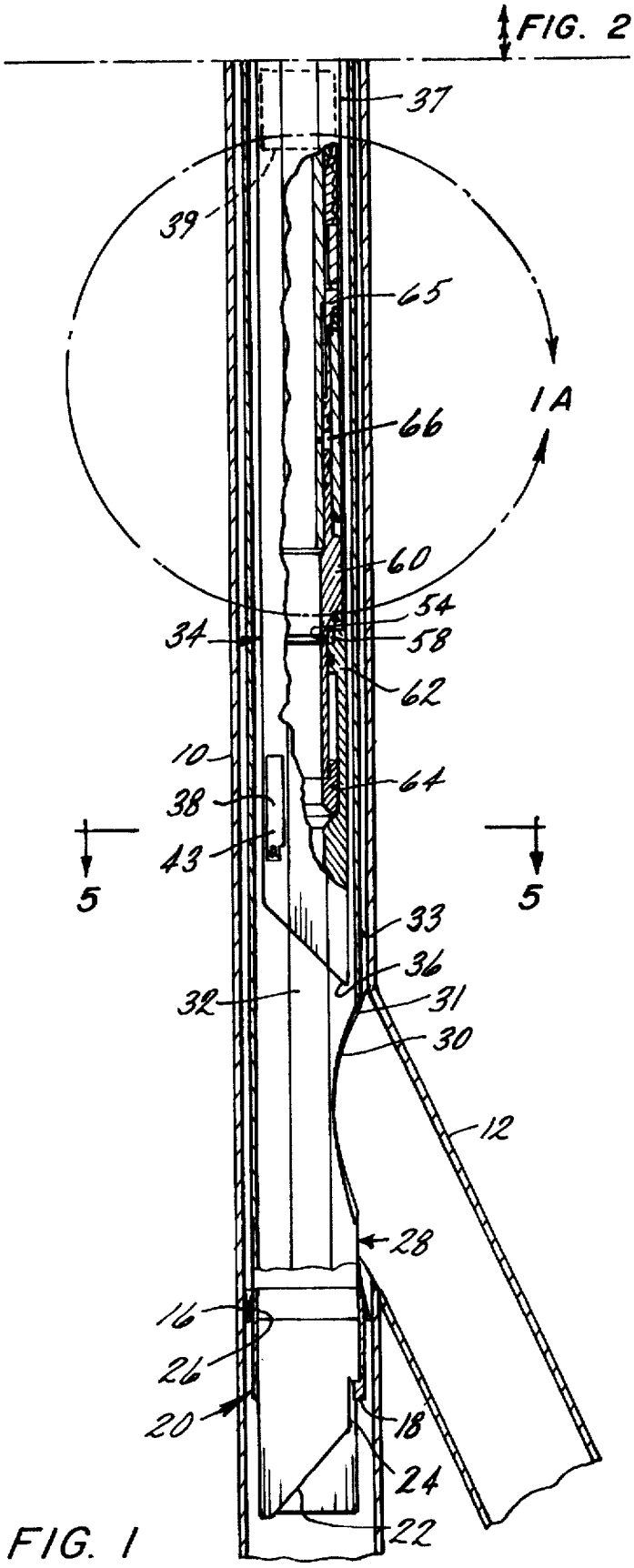
FIG. 1 is a lower section elevation/cross-section view of the invention in a down hole condition before deployment.

Referring now to FIG. 1, 10 indicates the "primary" wellbore which may or may not be vertical as suggested above. 12, then, indicates the "lateral" wellbore which likewise may or may not be horizontal. For purposes of clarity of discussion, these terms are assigned and the primary is considered to be more uphole than the lateral or in other words is a parent hole to the lateral. In other respects, primary and lateral do not have the general meanings of respectively vertical and horizontal. It must be understood that the primary for purposes of this specification may be horizontal or some degree thereof and the lateral may be vertical or some degree thereof.

As one of skill in the art will recognize, when a lateral wellbore is drilled, there generally is a whipstock (not shown) placed in primary 10 to deflect the drill string, in a predetermined direction. The whipstock is usually oriented and supported by a packer 16 such as a Baker Oil Tools' ML packers (product #415-62), which packer includes an orientation key 18. Because the packer 16 is left in position down hole after removal of the whipstock orientation and positioning of the apparatus of the invention is rendered reliable and efficient by employing an orientation anchor which is commercially available from Baker Oil Tools in Houston, Tex. as product #783-59.

The invention itself, in the most preferred embodiment, provides a device for reentering a lateral accurately and for providing an excellent window joint seal capable of withstanding 3500 psi and substantial heat which are common down hole conditions.

Still referring to FIG. 1, wellbore 10 is left with packer 16 (after removal of previously used tools) which now supports the assembly of the invention. Immediately at the lowest (in the drawing, not necessarily in the field) or most downhole point of the undeployed assembly, an orientation anchor 20 is illustrated. Orientation anchor 20 includes orienting slide 22 and keyway 24 so that as the assembly is lowered, the slide 22 and keyway 24 will engage key 18 and ensure proper orientation of the several other elements of the invention as discussed hereunder.

Packer 16 provides both a support structure and a seal by tightly mating with the circumferential perimeter of seal 26 located immediately above the keyway 24 and forming a part of orientation anchor 20. Seal 26 preferably possesses an outside diameter slightly larger than the inside diameter of packer 16 so that when seal 26 is forced into an equiplanar and coaxial position with respect to packer 16, by the substantial weight of the string thereabove, a very effective seal is obtained.

Figure 4A:
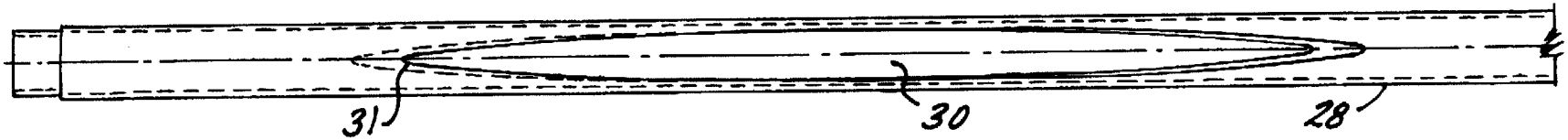
FIG. 4*a* is an elevation view turned 90° from FIG. 4.
Figure 4:
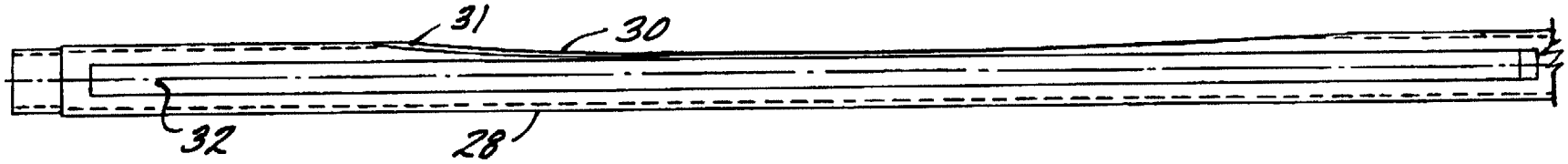
FIG. 4 is an elevation view of the window joint of the invention.
Figure 4B:
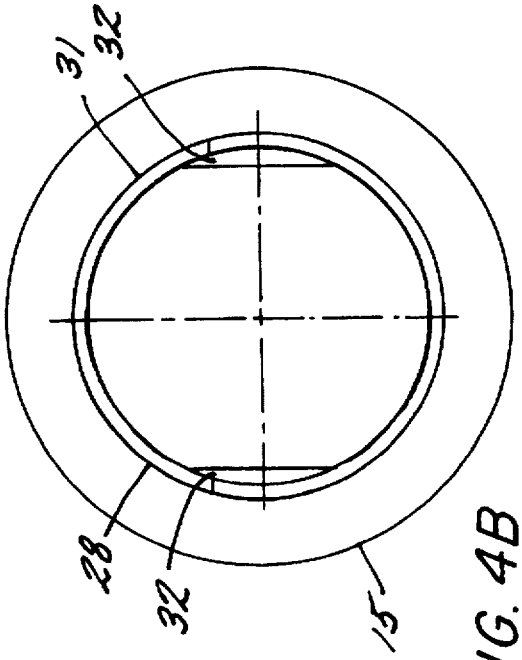
FIG. 4*b* is an end view of the window joint of the invention.

Connected to orientation anchor 20 referring to FIGS. 1, 4, **4*a* and 4*b* (moving upwardly in the figures and uphole in the field) is pre-machined window joint 28. Window joint 28 can be connected to orientation anchor 20 in a number of known ways. Window joint member 28 is pre-machined to mate substantially exactly with a machined flange and seal to be described hereunder. This provides a substantial degree of accuracy in sealing the lateral 12 which would otherwise be significantly more uncertain because of unknowns such as exact location, size and degree of collapse of a pre-existing lateral. Window joint 28 comprises an elongated tubular structure having an ellipsoidal opening 30. The opening is pre-machined to precise dimensions and location with respect to the orientation anchor 20. In this manner, the operator can be assured that the opening is aligned with the lateral 12 and that a sufficient seal can be made against the window periphery 31. As one of skill in the art will recognize, the opening is ellipsoidal because the lateral 12 intersects the primary 10 at an angle thus creating an ellipsoidal intersection. The particular dimensions of the ellipse are determined by the angle of divergence of lateral 12 to primary 10**.

To ensure that the production tube 34 (shown in FIGS. 1, **1*a*, 2, 3 and 4*b*) is oriented properly within window joint member 28, and thus will kick off into the lateral as desired, alignment plates 32 are positioned within window joint member 28, one on either side of window opening 30. With plates 32 installed, either by being milled in initially or being affixed to the i.d. of member 28 by conventional methods, only two orientations for tube 34 are possible, the correct one and 180° off. The likelihood of the tube 34 being assembled with window joint member 28 backwards is small. Alignment plates 32 also assist in preventing rotation of the production tube 34**.

Referring now to FIGS. 1, **1*a*, 2, 3, 5 and 6*a*, the production tube 34 which is to be placed in lateral 12 includes several unique features. Initially, it should be noted that production tube 34 is installed within the window joint member 28, preferably on the surface, and is then tripped down hole as a unit. As above mentioned, alignment plates 32** maintain the production tube in the proper orientation.

Prior to the production tube 34 being actuated, a stabilizing arrangement 33 is installed above opening 30 of window member 28 which locks the window member 28 in the desired position. More preferably, the stabilizing arrangement is a SAB-LT packer (commercially available from Baker Oil Tools of Houston, Tex., product #409-17). The SAB-LT packer does not move down hole when it is set and, therefore, is the choice of this operation. It will be appreciated that packer 16 is already set and will not allow downward movement of the inventive assembly, thus the static packer 33.

Figure 3:
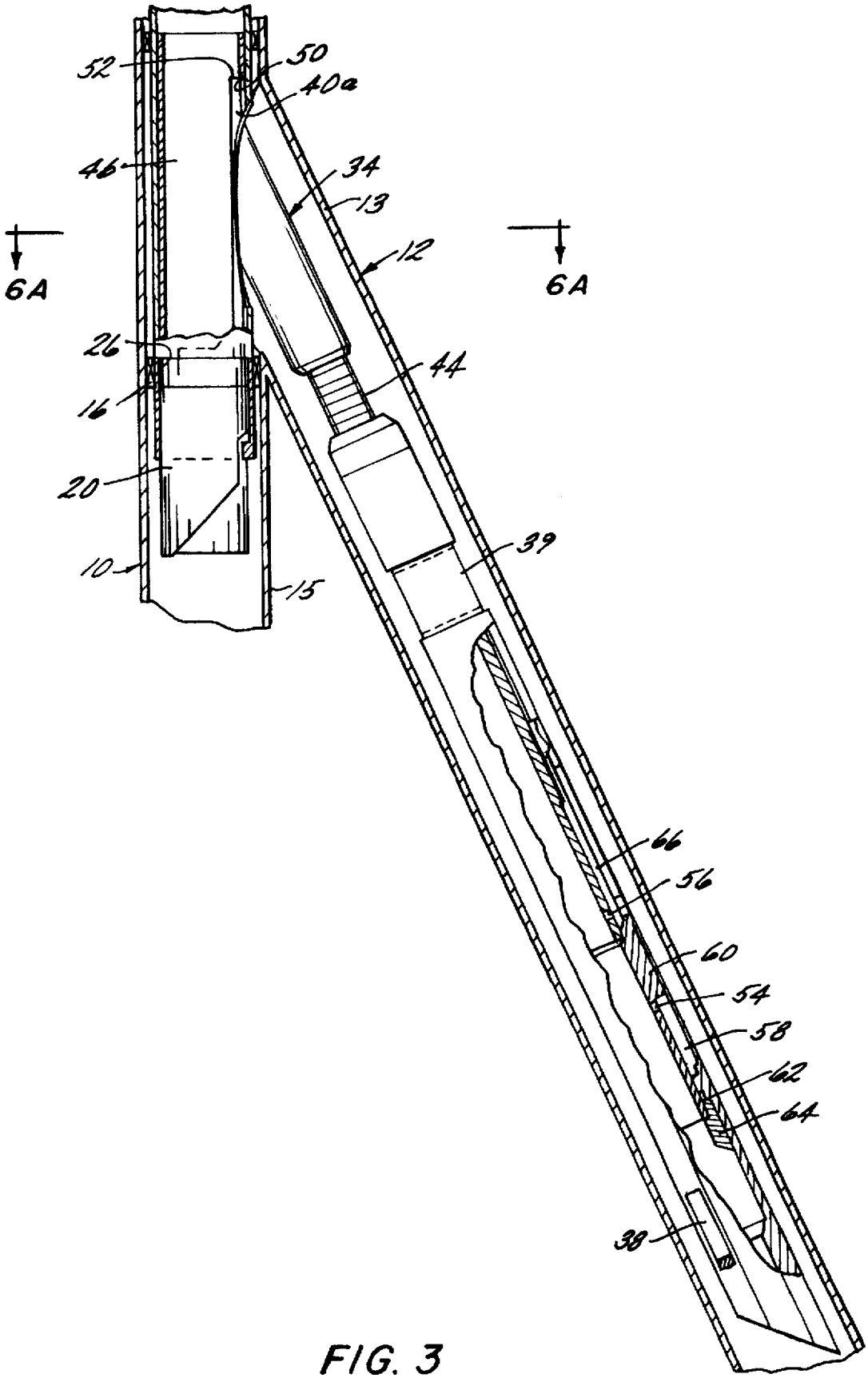
FIG. 3 is an elevation/cross-section view of the lower lateral section of the invention in the deployed condition.
Figure 5:
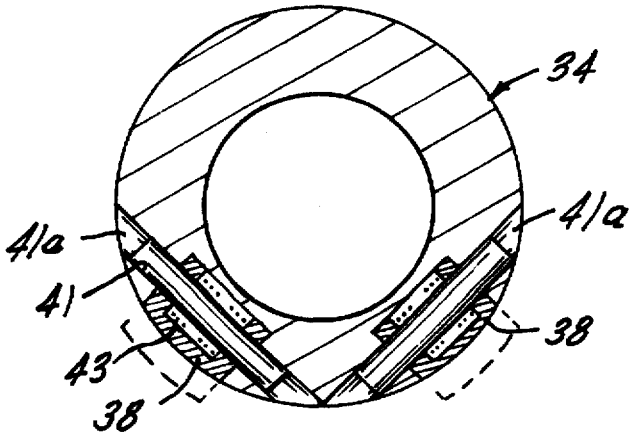
FIG. 5 is a cross-section of the production pipe taken along section line 5—5 in FIG. 1 which illustrates the position of the kickers of the invention.
Figure 6:
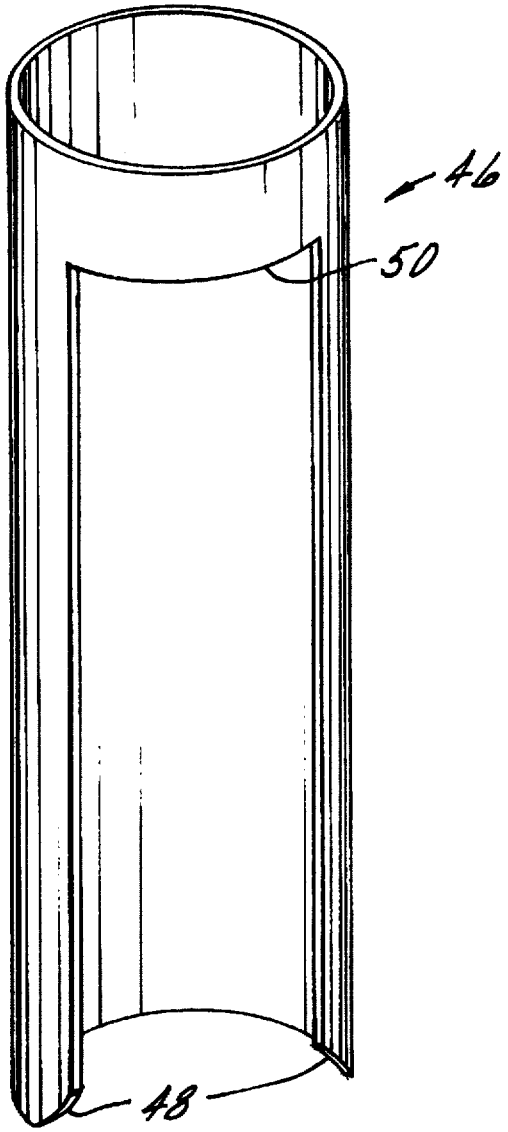
FIG. 6 is a perspective view of the energizing sleeve.

Once the assembly of the invention is orientated and stabilized, known means (hydraulic, mechanical, etc.) are employed to begin moving production tube 34 down hole toward window opening 30. When nose 36 is exposed to the lateral 12 by being moved into opening 30, kickers 38 are actuated to push nose 36 through opening 30 and into lateral 12. Kickers 38 are pivotable winglike members and as shown in FIGS. 1 and 5 are pivotable on pins 41 (disposed in pin bore **41*a*) under the bias of springs 43 as shown or other mechanical or hydraulic or electrical means. Motive means are continued until the entirety of tube 34 is pushed into lateral 12 and flange 40, having sealing element 42, is in contact with a periphery 31 of opening 30. It will be appreciated that in order for tube 34 to follow the angle of the lateral 12 from primary 10, bendable section 44 must be included as shown (FIGS. 1 and 3). Preferred embodiments of bendable section 44 include flexible tubing, an articulated joint, etc. one of skill in the art can substitute many arrangements for this feature without departing from the scope of the invention. It will also be apparent to the skilled artisan that the substitution of a bent sub for bendable section 44 may eliminate the need for the otherwise inherently weaker link and additionally may obviate the need for kickers 38. Because of inherent movements of tube 34 while being pushed into lateral 12 and the potentially great frictional forces between tube 34 and window opening 30 or lateral casing 13, a protective sleeve 37 is disposed around a section of tube 34 stretching from nose 36 to the uphole extent of packer 39 (which is preferably an SAB packer from Baker Oil Tools #409-07). The sleeve 37, therefore, protects packer 39 from damage while moving through window joint 28 and opening 30 as well as while the production tube 34 is moving down lateral 12. The sleeve is later "pumped off" as described hereinafter. It should be recognized that while the provision of sleeve 37 is preferred, it is not necessary and the invention will work without the sleeve, albeit at greater risk of damage to the packer 39**.

Figure 2:
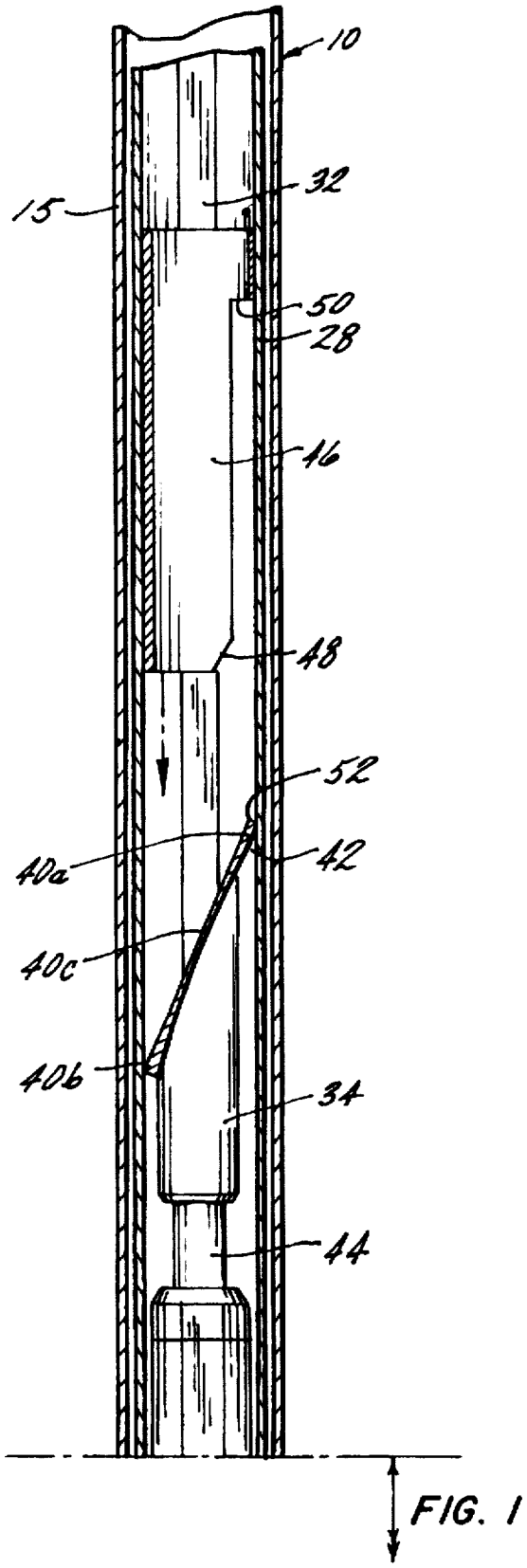
FIG. 2 is an upper section elevation/cross-section view of the invention in the undeployed condition.
Figure 1A:
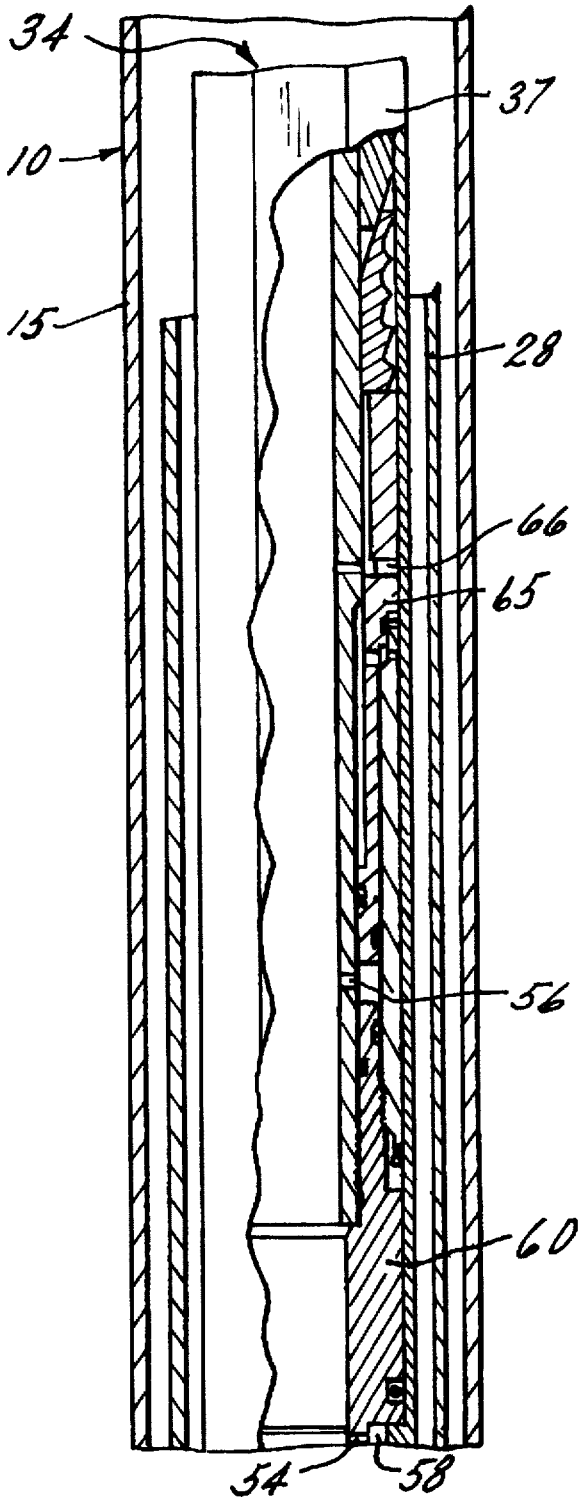
FIG. 1*a* is an enlarged portion of FIG. 1 which is circumscribed in FIG. 1 as 1*a*—1*a;*

Flange 40 and sealing element 42 (referring to FIGS. 2 and 3) are disposed up hole from the elements described immediately hereinabove. The distance by which the above elements are separated is a function of the application and, therefore, may be relatively long or relatively short without departing from the scope of the invention. Flange 40 is carefully attached to tube 34 whether milled, welded, fastened, secured or otherwise attached, at an angle and curvature which is preselected to provide a substantially mating interface between the seal 42 and opening periphery 31. The tolerances are reasonably precise such that a seal capable of withstanding about 3500 psi and high temperature, common to down hole conditions is formable. In the most preferred embodiment seal 42 is an elastomeric compound, however, it will be understood that other compounds including ductile metal compounds are applicable and may be preferable in some conditions.

In order to energize the seal 42, and depending upon conditions and application, it may be desirable to physically bias the flange 40 from within the window joint 28 or by introducing a down hole pull from a mechanism further downhole in lateral 12. In the most preferred embodiment of the present invention both of the arrangements are employed.

Figure 6A:
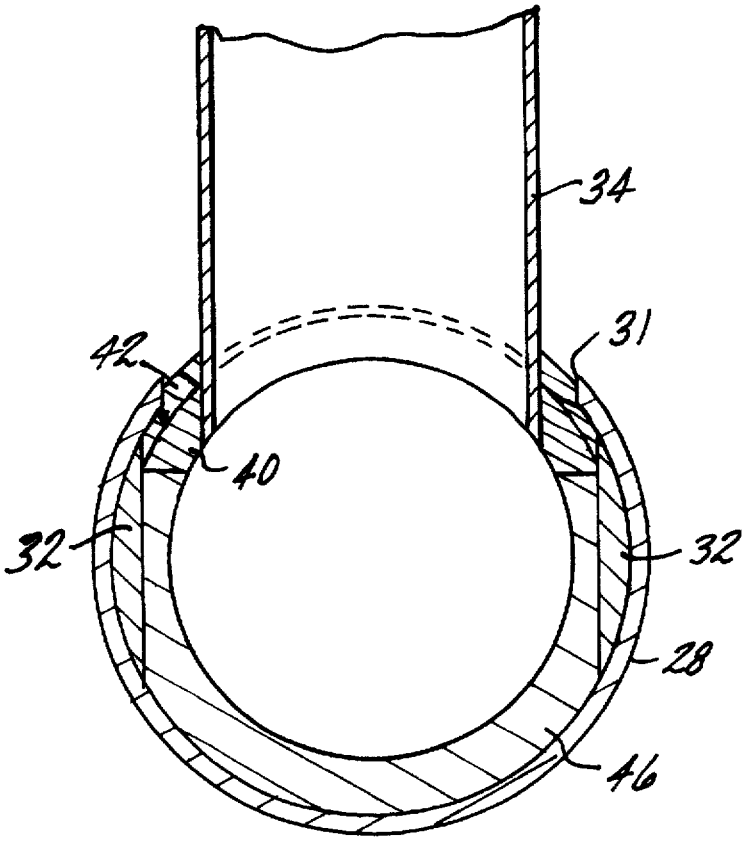
FIG. 6*a* is a sectional view taken along section line 6*a*—6*a*.

Referring to FIGS. 1, 2, 3, 6 and 6*a*, the energizing sleeve 46 is illustrated in the preferred embodiment of a cylinder having a section removed as shown, and a ramp 48 at a downhole end thereof. Sleeve 46 is urged downhole within the window joint 28 and is in a set position when stop 50 abuts crown 52 of flange 40. In this position, sleeve 46 is in contact with flange 40. It should be noted that, as shown in FIG. 6*a*, sleeve 46 also is possessed of flattened or milled sides to maintain its position and orientation within window member 28 by embracing with alignment plates 32. As will be apparent to one of skill in the art, the flat edged sleeve 46 would appear to make contact with flange 40 only at the side apices of the ellipsoidal opening 30 because of the curvature of the window member 28, however, the flange 40 is of a thicker cross-section at uphole 40*a* and downhole 40*b* ends and of a narrower cross-section at the sides 40*c*. This provides for a much more constant surface upon which pressure from the energizing sleeve 46 is distributed. A good seal can thus be maintained. Moreover, with careful machining and precise tolerance, the energizing sleeve 46 alone may be sufficient for withstanding the high temperature and pressure (about 3500 psi).

Alternatively or conjunctively a downhole pulling arrangement, the most preferred being a packer 39 such as a Baker Hughes SB packer (product #40907), may be employed to assist or solely provide the bias of the seal of flange 40 against window opening periphery 31. As will be appreciated by one of skill in the art the SB type packer moves downhole as it is set, to allow the slips to set properly. This downhole movement is, in the context of this invention, harnessed to pull the production tube 34 farther downhole thereby creating an even tighter interface between flange 40/seal 42 and opening periphery 31. The most preferred embodiment of this invention employs the energizing sleeve and the packer.

Referring now to FIGS. 1 and 3, the above mentioned protective sleeve 37 is illustrated in various positions on or off the packer 39. As was stated hereinabove, the sleeve is not necessary to the operation of the invention, however, is preferred to prevent damage to packer 39. Where the sleeve 37 is utilized, the preferred method and apparatus for operating the sleeve is as follows. Provision (not shown) is made for conventionally supplying a pressurized fluid to the vicinity of sleeve release port 54 and packer expansion port 56. Fluid then travels in the direction of arrows through ports 54 and 56 into chamber 58 and chamber 66, respectively. Sleeve 37 is initially maintained in the protective position by at least one shear pin (the use and position of which are known to the art) having a predetermined shear point calibrated to a particular amount of pressure. When the pressure of fluid flowing through port 54 into chamber 58 exceeds the shear point of the pin(s) the sleeve 37 is pumped off revealing the packer 39. As can be ascertained by a review of FIGS. 1 and 3, the port 54 leads to a chamber 58 which is forced to expand longitudinally under the influence of the fluid pressure. Chamber 58 is defined by an annular segment 60 which retains its position and sleeve 37 which is slidable. Sleeve 37 will continue to slide downhole under fluid pressure until stop nub 62 impacts end brace 64 which is fixedly connected to anchor segment 60. It will be appreciated in FIG. 3 that when the sleeve 37 stops downhole movement it has exposed packer 39 for deployment. At this time, pressure increases from the fluid because it can no longer escape into chamber 58 whose volume had been increasing. Upon system pressure reaching a second predetermined amount, a second at least one shear pin is sheared allowing packer slide 65 to move as fluid enters chamber 66 through port 56. Packer slide 65 impacts packer 39 and initiates deployment thereof against the i.d. of lateral 12 to both stabilize production tube 34 and draw the same downhole for purposes of sealing the window joint as stated above.

In another embodiment of the invention, the window joint member 28 possesses an opening 30 which is substantially larger than flange 40 and seal 42 and which will allow deposition of production tube 34 into and sealing of flange 40 immediately against the casing 13 of lateral 12. This allows the window member 28 to be removable, freeing internal pipe space in primary 10.

In this embodiment it will be understood that energizing sleeve 46 is not utilized. This, of course, means that the downhole pulling device (e.g., packer 39) must provide the seal 42 tightness. There is also, however, another embodiment wherein there is no window joint member 28 at all. Rather, the casing of primary 10 is treated as the window member, and the lateral seal is created directly at the casing 13 of lateral 12. One of skill in the art is easily able to visualize that which is here disclosed. In this case, the energizing sleeve may be positioned against the primary 10 casing 15 to urge flange 40 and seal 42 into pressurized contact with the lateral casing 13. It is also possible, of course, as in the previous embodiment that the energizing sleeve may be omitted or the packer may be omitted.

The latter two embodiments are generally directed to newer wells where reasonable certainty may be had regarding the condition of the lateral (i.e., breakdown, occlusion, etc) whereas the former preferred embodiment is a superior arrangement for older wells when said conditions and thus the ability to effect a seal are more elusive.

Obviously, the preferred embodiment is also quite suited to newer wells.

While preferred embodiments have been shown and described, various modification and substitutions may be made thereto without departing from the spirit and scope of the invention. Accordingly, it is to be understood that the present invention has been described by way of illustration and not limitation.

What is claimed is:

1. A lateral seal and control system comprising:

a) a first borehole having a window therein;

b) a secondary borehole extending from said first borehole, coextensive with said window; and c) a secondary borehole production pipe having a flange about the periphery of an uphole end of said pipe said flange being sealably engageable with a periphery of said window; and d) a sleeve disposed in said first wellbore said sleeve being wedgeable between said flange and a wall of said first borehole opposed to said window.

2. A lateral seal and control system as claimed in claim 1 wherein said pipe is further urged downhole by a pulling mechanism disposed downhole so that said flange seals against said periphery of said window.

3. A lateral seal and control system as claimed in claim 2 wherein said pulling mechanism is a packer.

4. A lateral seal and control system comprising:

a) a first borehole having a first window therein said window having a periphery;

b) a second borehole extending from said first borehole coextensive with said window;

c) a housing having a premachined window and an orientation sub for orienting said premachined window with said first window;

d) a production pipe including a flange at an uphole end thereof, said flange being of larger dimension than said premachined window; said pipe being maintained substantially within said housing during run in and being movable from the run in position to a deployed position wherein said flange is mated against said periphery of said premachined window.

5. A lateral seal and control system as claimed in claim 4 wherein said flange is energized against said periphery of said window by a sleeve.

6. A lateral seal and control system as claimed in claim 4 wherein said flange is energized against said periphery of said window by a packer.

7. A lateral seal and control system as claimed in claim 4 wherein said flange is energized against said periphery of said window by both a sleeve and a packer.

8. A lateral seal and control system as claimed in claim 4 wherein said housing further includes a kicker to facilitate exit of the pipe from the housing at a predetermined time.

9. A lateral seal and control system as claimed in claim 8 wherein said kicker is a guide stock.

10. A lateral seal and control system as claimed in claim 8 wherein said kicker is at least one spring loaded member.

11. A lateral seal and control system as claimed in claim 10 wherein said at least one member is at least two members.

12. A lateral seal and control system as claimed in claim 4 wherein said housing is oriented by engaging with a previously set whipstock packer.

13. A lateral seal and control system as claimed in claim 4 wherein said housing is oriented by a slot and lug arrangement.

14. A lateral seal and control system as claimed in claim 13 wherein said slot and lug arrangement provides for selective engagement and thereby selective secondary borehole entry.

15. A lateral seal and control system as claimed in claim 4 wherein said production pipe includes a kicker to facilitate exit from said housing at a desired time.

16. A lateral seal and control system as claimed in claim 15 wherein said kicker is a bent sub.

17. A lateral seal and control system as claimed in claim 1 wherein said seal withstands at least 3500 psi.

18. A lateral seal and control system as claimed in claim 4 wherein said seal withstands at least 3500 psi.

19. A lateral seal and control system as claimed in claim 1 wherein said flange includes an elastomeric sealing element.

20. A lateral seal and control system as claimed in claim 4 wherein said flange includes an elastomeric sealing element.

21. A method for sealing the junction between a branch wellbore and a parent wellbore comprising:

a) installing a housing having a premachined window therein such that said premachined window is aligned with said branch borehole;

b) running through said premachined window, a pipe having a flange at an uphole thereof, said flange being of larger dimension than said premachined window;

c) urging said flange against a periphery of said premachined window to seal said flange with said periphery of said premachined window.

22. A method for sealing the junction between a branch wellbore and a parent wellbore as claimed in claim 21 wherein said flange includes a seal material.

23. A method for sealing the junction between a branch wellbore and a parent wellbore as claimed in claim 22 wherein said seal material is elastomeric material.

24. A method for sealing the junction between a branch wellbore and a parent wellbore as claimed in claim 21 wherein said urging is carried out by wedging a sleeve between said flange and an opposing side of said parent wellbore.

25. A method for sealing the junction between a branch wellbore and a parent wellbore as claimed in claim 21 wherein said urging is carried out by a packer disposed downhole in said branch wellbore.

26. A method for sealing the junction between a branch wellbore and a parent wellbore as claimed in claim 21 wherein said urging is carried out by both of wedging a sleeve between said flange and an opposing side of said parent wellbore and by a packer disposed downhole in said branch wellbore.

27. A method for sealing the junction between a branch wellbore and a parent wellbore comprising:

a) drilling a parent wellbore;

b) drilling a window and branch wellbore by placing a deflecting tool in the parent wellbore and running a drill string from the parent wellbore;

c) removing the deflecting tool;

d) running a production tube having a flange at the uphole end thereof;

e) kicking said production tube into the branch wellbore and urging the same downhole by wedging a sleeve between said flange and an opposing side of said parent wellbore until said flange is in sealed contact with a periphery of said window.

28. A method for sealing the junction between a branch wellbore and a parent wellbore as claimed in claim 27 wherein said urging is further carried out by a packer disposed downhole in said branch wellbore pulling on said production tube.

29. A method for sealing the junction between a branch wellbore and a parent wellbore as claimed in claim 27 wherein the step of kicking the production tube into the branch wellbore includes providing a bent sub in the production tube which wraps a downhole end of said tube toward said branch wellbore.

30. A method for sealing the junction between a branch wellbore and a parent wellbore as claimed in claim 27 wherein the step of kicking the production tube into the branch wellbore includes providing at least one kicker to kick the tube into the branch wellbore.

* * * * *